US006857825B1

(12) United States Patent
Morrell

(10) Patent No.: US 6,857,825 B1
(45) Date of Patent: Feb. 22, 2005

(54) RETAINING WALL BLOCK AND WALL GRID SYSTEM

(76) Inventor: Kelly J. Morrell, 8350 Decathlon Dr., Spicer, MN (US) 56288

( * ) Notice: Subject to any disclaimer, the term of this patent is extended or adjusted under 35 U.S.C. 154(b) by 0 days.

(21) Appl. No.: 10/335,361

(22) Filed: Dec. 31, 2002

(51) Int. Cl.[7] ..... E02D 29/02
(52) U.S. Cl. ..... 405/286
(58) Field of Search ..... 405/284, 286; 52/603, 604, 609; D25/113, 114, 115, 118; 47/83, 33

(56) References Cited

U.S. PATENT DOCUMENTS

| | | | | |
|---|---|---|---|---|
| 4,914,876 A | | 4/1990 | Forsberg | |
| 5,294,216 A | | 3/1994 | Sievert | |
| 5,607,262 A | | 3/1997 | Martin | |
| 5,816,749 A | * | 10/1998 | Bailey, II | 405/286 |
| 5,820,304 A | * | 10/1998 | Sorheim et al. | 405/286 |
| 6,019,550 A | | 2/2000 | Wrigley et al. | |
| 6,142,713 A | * | 11/2000 | Woolford et al. | 405/286 |

OTHER PUBLICATIONS

"Keystone Intermediate" Keystone Retaining Wall Systems product literature, 1994, 2 pages.

* cited by examiner

*Primary Examiner*—Michael Safavi
(74) *Attorney, Agent, or Firm*—Moore, Hansen & Sumner

(57) ABSTRACT

A retaining wall block and a system and method for constructing a retaining wall with multiple blocks laid in successive courses. The system comprises a plurality of building blocks and a flexible anchor grid. Each block has top and bottom surfaces, front and rear surfaces, opposing side surfaces, and a downwardly extending engagement section. The downwardly extending engagement section is configured to be directly connected to a sheet of flexible, pliant anchoring material of the type having plurality of perforations. The sheet of anchoring material is laid over a course of blocks and extended into earth fill behind the wall. The downwardly extending engagement section is also configured to engage and position adjacent courses of blocks relative to each other in a predetermined, setback relation. Preferably, the engagement section has one or more teeth that are arranged in a linear row and which are constructed and arranged to project through apertures in the anchoring grid sheet.

6 Claims, 3 Drawing Sheets

RETAINING WALL BLOCK AND WALL GRID SYSTEM

FIELD OF THE INVENTION

The present invention generally relates to masonry blocks. More particularly, the present invention relates to retaining walls that are constructed using masonry blocks in conjunction with a flexible anchor grid.

BACKGROUND OF INVENTION

Dry-stack masonry blocks have been known and used for many years. They are quite popular because they do not require extensive site preparation or the services of skilled craftsmen. Instead, dry-stack masonry blocks allow most any able-bodied person to create a variety of structures, typically low walls or planters. In such applications, the blocks usually have sufficient weight to resist forces exerted by retained material (for example, such as soil and gravel backfill). However, as the height of the structures becomes greater they are subjected to forces exerted by the material being retained, and one or more blocks may become dislodged and/or a portion of the structure may bulge or bow outwardly and/or forwardly. This creates not only aesthetically displeasing view, but also a potentially hazardous condition. That is, dislodged blocks detract from the overall pattern and design of the structure and dislodged blocks may fall and injure a passerby, or fall and subsequently obstruct the normal flow of traffic. Understandably, such conditions require timely repair in order to minimize adverse consequences. This usually entails removing some backfill, removing the dislodged blocks and resetting them in their proper orientation, and then replacing the backfill. Sometimes this must be done more than one time, particularly if drainage is a problem. In extreme cases, the entire structure may have to be deconstructed and rebuilt. As one may imagine, such repair work adds to the total cost of the structure.

Attempts to counteract the forces involved in structures such as retaining walls have taken several approaches. One approach that is quite common to the industry is to manufacture the masonry blocks so that when they are assembled into a retaining wall structure, the retaining wall has an upwardly receding slope or batter. This slope, or batter, is usually accomplished by interlocking adjacent courses of blocks. Typically, this may include integrally formed projections that extend upwardly or downwardly relative to the block and which serve to position a block in a predetermined relation to adjacent courses of blocks. Alternatively, this may include pins or pegs that are configured to fit into vertically oriented holes in the top and bottom surface of the blocks and which serve to tie blocks in adjacent courses to each other. This approach has proved to be quite effective in medium sized wall structures. However, as retaining wall structures grow higher and higher, even these approaches sometimes fail and blocks can become dislodged and/or walls may collapse.

In order to solve this shortcoming, many of the above-mentioned retaining wall constructions are provided with flexible, pliant anchor grids of sheet-like plastic material, commonly known in the trade as a geo-grid. In use, flexible anchor grids are installed as the retaining wall is constructed with one end of the flexible grid positioned between adjacent courses of blocks and the remaining portion of the flexible grid extending onto the material being retained, where it becomes embedded as succeeding courses are laid and more backfill material is added.

As one may expect, retention of a flexible anchor grid between courses of blocks in a wall structure is of utmost importance, and there have been several approaches to flexible anchor grid retention, each of which have met with varying degrees of success. One approach, common to blocks with integrally formed projections or indexing flanges is to merely position the flexible grid between adjacent courses of blocks during wall construction. This creates several right angle bends at the end of the flexible grid, which results in increased frictional resistance to movement between the blocks and the flexible grid (see, for example, U.S. Pat. No. 5,294,216). A drawback with this approach is that the frictional forces may be overcome and a block or blocks may become dislodged. Another drawback is that when a flexible anchor grid is bent over at a right angle, the longitudinal strands can lose strength and cause the flexible grid to fail prematurely. Moreover, the flange, against which the flexible grid is positioned, may dig into and sever the longitudinal strands of the flexible grid and also cause premature failure.

Another approach, common to those blocks that utilize pins or pegs to connect adjacent courses of blocks is to connect the flexible grid to the pins by looping them about the pegs (see, for example, U.S. Pat. No. 4,914,876). A drawback with this manner of connecting the flexible grid to the blocks is that forces are concentrated at points rather than along the width of the flexible grid. That is, the connecting pins contact the transverse strands of the flexible grid at only two points. As one may imagine, this can lead to premature failure and possible dislodgement of the blocks. Moreover, some flexible grids are manufactured so that the longitudinal strands have a greater breaking strength than the transverse strands. Thus, when flexible grids such as these are used with a pin connection system the effect of the stress points is accentuated and failure can occur at an even earlier stage.

Yet another approach is to use intermediate connectors to connect a flexible grid to a block or blocks (see, for example, U.S. Pat. No. 6,019,550). Intermediate connectors usually take the form of a bar that connects to the grid, and which fits within a transverse recess in the upper surface of the block. Typically, the bar is provided with a plurality of projections that engage apertures in the flexible grid and which bear against the transverse edges of the apertures. Some disadvantages with this approach are that it requires additional parts, it requires machinery to fabricate the parts, it adds to construction time, and it requires user education and training. Moreover, the parts can be misplaced, misused, or damaged.

There is a need for a building block that may be used in conjunction with a flexible anchor grid. There is also a need for a building block that is able to directly engage a flexible anchor grid. There is yet another need for a building block that is able to position itself in an offset relation relative to building blocks in adjacent courses of blocks. And, there is a need for a simple and direct method of constructing a retaining wall in which building blocks used to construct the retaining wall can be connected to a flexible anchor grid.

SUMMARY OF THE INVENTION

This invention is directed to a retaining wall block and wall grid system. The system comprises a plurality of building blocks that may be arranged in a plurality of courses to form a structure such as a retaining wall, and at least one flexible anchor grid that is positioned between adjacent courses of blocks and which extends into material that is being retained.

The flexible anchor grid is directly connected to one or more blocks such that a block or blocks are able to resist the forces exerted by the retained material and thus prevent accidental dislodgement and or bowing. The connection between the flexible anchor grid and a block is achieved by providing the block with an engagement member that extends from the block in a generally perpendicular direction, and which is configured to engage a flexible anchor grid by projecting through one or more apertures formed therein.

Preferably, the engagement member comprises a plurality of downwardly extending, linearly aligned teeth and the flexible anchor grid is of the type comprising a sheet of pliable material having at least one series of linearly arranged apertures, or perforations. More preferably, the flexible anchor grid comprises a mesh-like sheet of plastic material, in which the apertures are formed and defined by longitudinal and transverse strands.

An object of the present invention is to provide a building block that may be used to construct a structure such as a retaining wall.

Another object of the invention is to provide a building block that may be used in conjunction with flexible anchor grids.

Still another object of the invention is to provide a building block that is able to be positioned upon another building block in a predetermined interlocking relation.

A feature of the invention is that a building block can be positively and directly connected to a flexible anchor grid without the use of extraneous or supplemental devices, or specialized tools.

Another feature of the present invention is that the building block is self-indexing, to permit adjacent courses of blocks to automatically offset relative to each other.

An advantage of the present invention is that a building block may be used with or without a flexible anchor grid.

Another advantage of the invention is that the connection between a building block and a flexible anchor grid is simplified.

These advantageous features are achieved by providing a plurality of teeth projecting from the bottom surface of a building block, with the teeth being constructed and arranged in a predetermined, spaced apart relation so as to project into and engage apertures in an anchor grid.

These and other objects, features and advantages of the present invention will become apparent from the following detailed description thereof taken in conjunction with the accompanying drawing, wherein like reference numerals designate like elements throughout the several views.

DETAILED DESCRIPTION OF THE INVENTION

Figure 1:
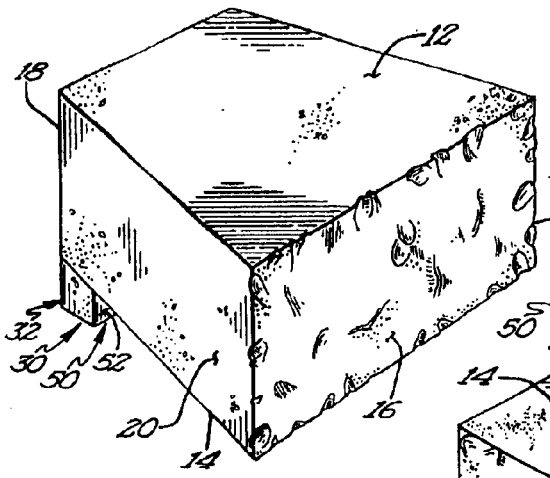
FIG. 1 is a front facing perspective view of a preferred embodiment of the block of the present invention.
Figure 2:
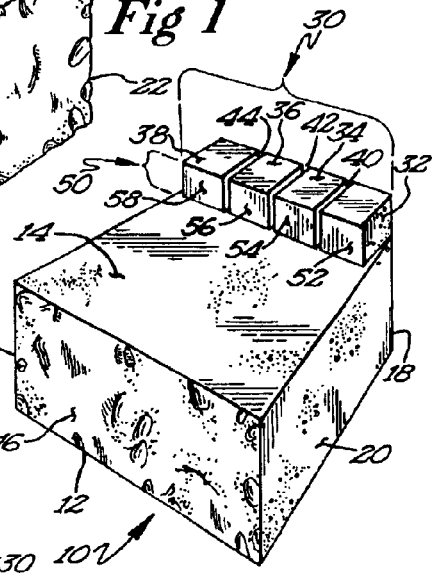
FIG. 2 is an inverted perspective view of the block of FIG. 1 showing the bottom surface.
Figure 3:
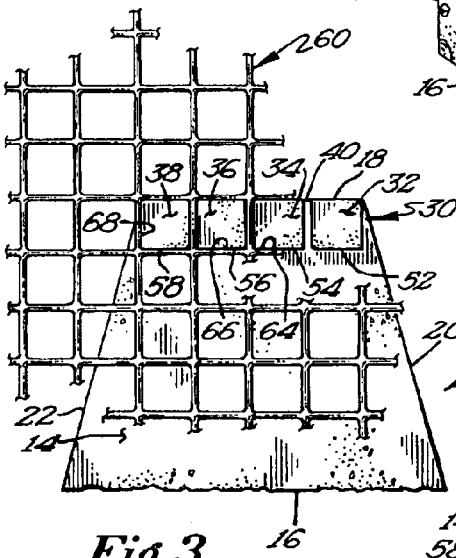
FIG. 3 is a bottom plan view of the block of FIG. 1, shown in combination with an anchor grid.

Referring generally to FIGS. 1–7, there is shown a building block 10 and a flexible anchor grid 60 that form a system by which various structures may be constructed. Preferably, the building blocks 10 and the anchor grid 60 are used to construct a retaining wall S. As can be seen in FIGS. 1–3, building block 10 includes a top surface 12, a bottom surface 14, a front surface 16, a rear surface 18, and opposing side surfaces 20, 22 that extend between the top, bottom, front, and rear surfaces, with the aforementioned surfaces defining the general shape of the block. In a preferred embodiment, the top 12 and bottom 14 surfaces become wider as they near the front surface 16 and narrower as they near the rear surface 18, resulting in a generally trapezoidal shape. The trapezoidal shape is preferred because it allows the front surfaces of adjacent blocks in a course of blocks to remain in close proximity to each other when a course of blocks is arranged in an arcuate or curved manner, which minimizes vertical gaps therebetween. This results in a structure S having an aesthetically pleasing overall appearance (see, FIG. 5). It will be appreciated, however, that other block configurations are possible. For instance, the block configuration may be a square, a rectangle, or a polygon.

With reference to FIGS. 1 and 2, a preferred embodiment of a building block 10 has a front surface 16 depicted as being roughened, to simulate the appearance of a stone that has been quarried from a larger matrix of material. It will be appreciated, however, that other surface texturing and designs are possible. For example, the surface may be smooth and planar, curved, or have more than one planar surface (see, the front surfaces of the blocks of the lowermost course C1 of structure S, FIG. 5).

The building block 10 also includes an engagement section 30 that extends downwardly relative to the normal orientation of usage of the block 10. Generally, the engagement section 30 has an orthogonally oriented abutment surface 50 that has several functions, one of which is to operatively connect the block 10 to a flexible anchor grid 60, another of which is to automatically position the block in an offset relation relative to an adjacent course of blocks.

Generally, the engagement section 30 is configured and arranged to be directly connected to a flexible anchor grid 60. More specifically, the engagement section 30 comprises a plurality of teeth that are configured and arranged to project through perforations or apertures in a flexible anchor grid 60. Preferably, the teeth are aligned with each other in a linear fashion. That is, they are in a row that corresponds to a row of apertures that are formed by longitudinal and transverse strands in a typical flexible anchor grid. It will be understood, however, that the teeth may be arranged in a nonlinear fashion, just so long as they are able project through corresponding apertures in an anchor grid 60. For instance, the teeth may be arranged in an alternating pattern between two or more rows. Alternatively, the teeth may be arranged in one or more diagonal patterns.

Figure 5:
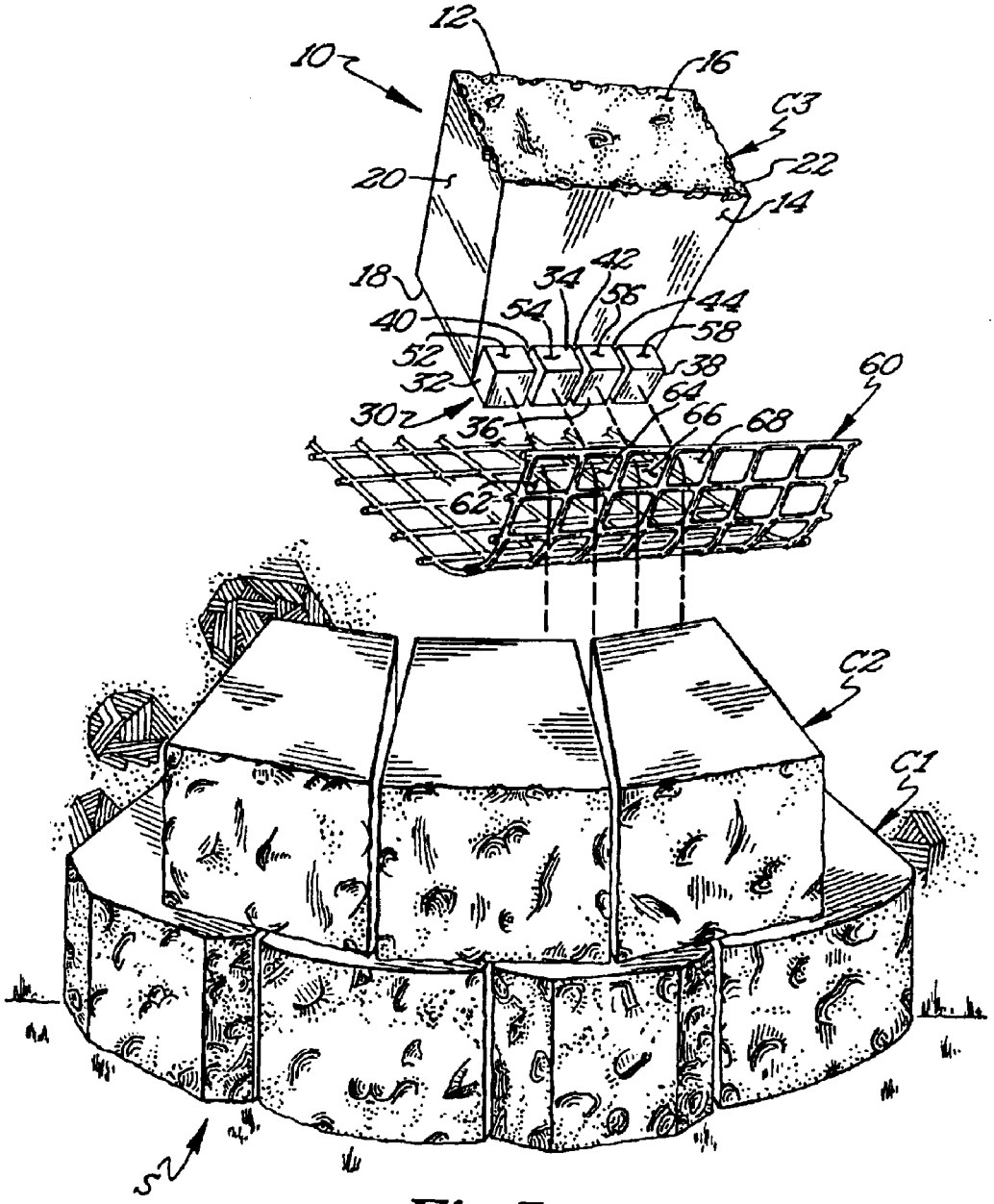
FIG. 5 is a front facing perspective view of a plurality of blocks arranged in a plurality of courses to form a wall structure and a flexible anchor grid that may be interposed between two courses of blocks.
Figure 6:
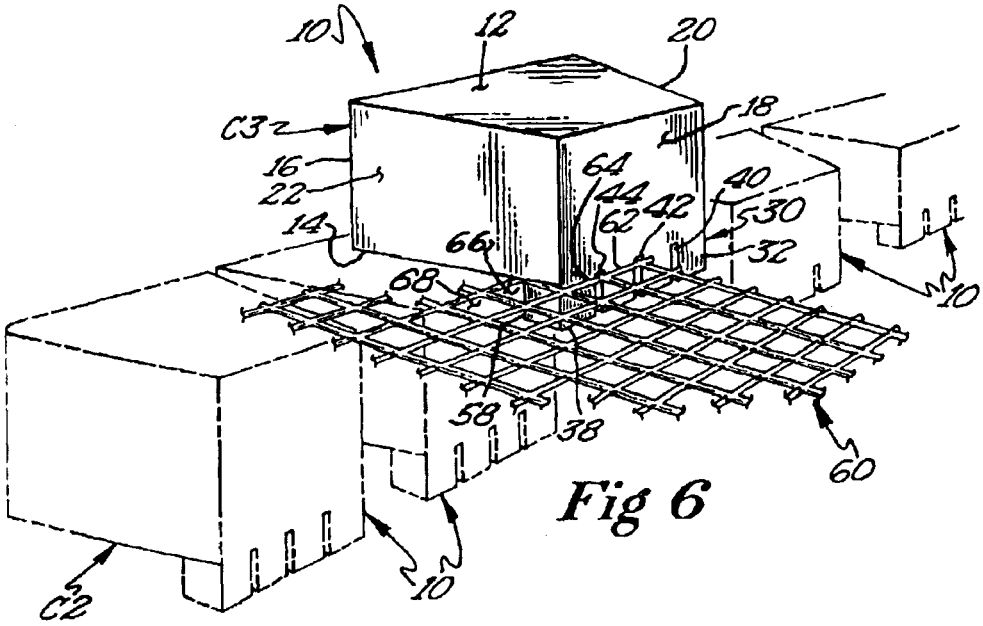
FIG. 6 is a rear facing perspective view of plurality of blocks arranged in a plurality of courses to form a wall structure and a flexible anchor grid that may be interposed between two courses of blocks; and, FIG. 7 is a side elevation view of a plurality of blocks arranged in a plurality of courses to form a wall structure, with the wall structure operatively connected to a plurality of flexible anchor grids.
Figure 7:
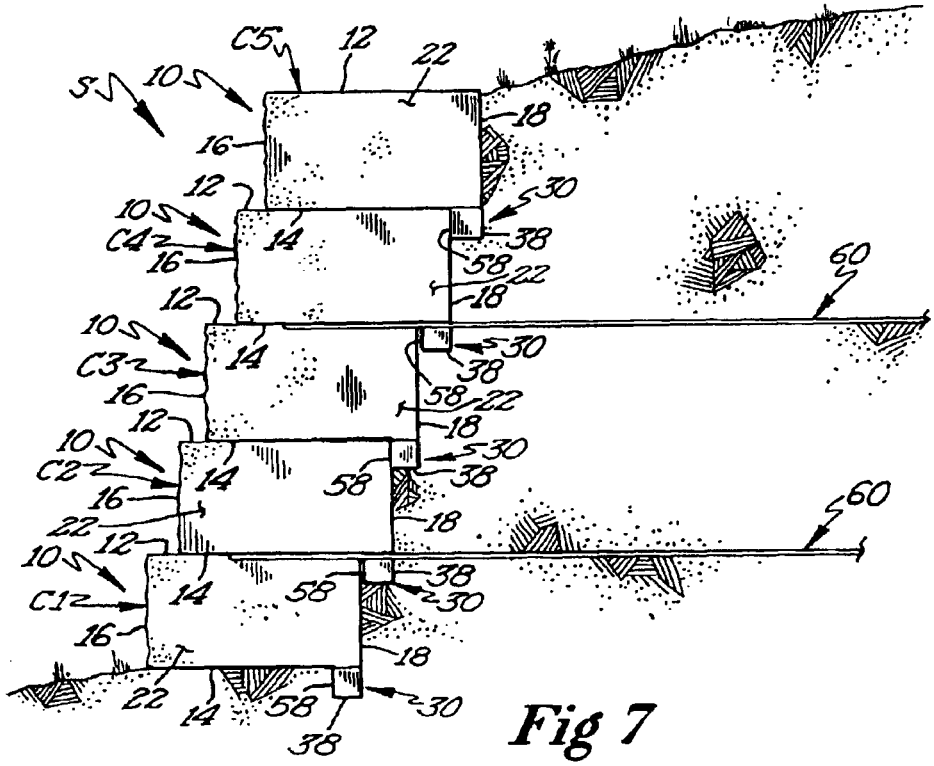

As depicted in the drawings, the teeth 32, 34, 36, 38, of the engagement section 30 are sized to project through the apertures 62, 64, 66, 68, in a flexible anchor grid 60 such as a geo-grid, without unduly stressing the strands, or otherwise requiring modifications, such as by removing portions thereof. This reduces stress points and allows loading to be distributed more evenly between the block 10 and the grid 60. It also allows the anchor grid to remain relatively planar and free of bends or angles that reduce the tensile strength of the flexible anchor grid. There are several methods in which the flexible anchor grid may be attached to a block. One method is to attach the flexible grid using the apertures located along an edge of a flexible anchor grid, as depicted in FIG. 5. The other method is to attach the flexible grid using the apertures located inboard from the edge of a flexible anchor grid, as depicted in FIGS. 3, 6, and 7. The latter method is preferred because it positions a portion of the flexible anchor grid between the upper and lower courses of adjacent blocks and uses the weight of the blocks to further secure the flexible anchor grid to the structure.

With this in mind, it will be appreciated that the configuration of the teeth is generally uniform, and preferably corresponds to the shape of typical flexible anchor grid apertures formed by longitudinal and transverse strands. And, because the dimensions of the apertures in one flexible anchor grid design may be larger or smaller than the dimensions of the apertures in another flexible anchor grid design, it will also be appreciated that the teeth of the engagement section may also have different dimensions. Thus, the teeth may have a width in the range of about 0.50 to 4.00 inches (1.27 to 10.16 cm), a depth in the range of about 0.50 to 2.00 inches (1.27 to 5.08 cm) and a height in the range of about 0.30 to 2.00 inches (0.76 to 5.08 cm). It will be understood, then, that the number of teeth in an engagement section may vary depending upon the size of the block.

Figure 4:
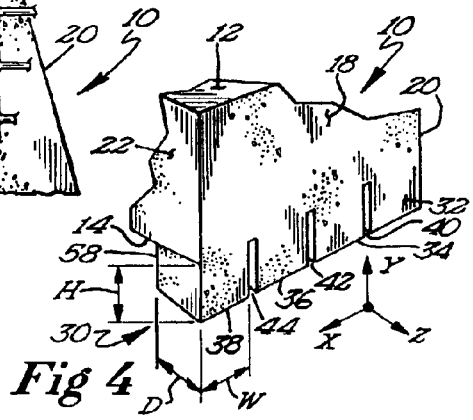
FIG. 4 is a partial, perspective view of the engagement section of the block of FIG. 1 viewed from the rear of the block.

As can be seen in FIGS. 2 and 4, the engagement section 30 is depicted as comprising four teeth 32, 34, 36, 38, with each tooth 32, 34, 36, 38, generally rectangular in shape and including a generally perpendicularly oriented abutment surfaces 52, 54, 56, 58, respectively, upon which a strand of a flexible anchor grid may be positioned. Although the contact surfaces 52, 54, 56, 58, depicted are substantially planar, it is understood that the abutment surfaces may be somewhat cylindrically shaped, if desired, to reduce the number of sharp edges that may cut into the strands of the anchor grid. Moreover, the teeth 32, 34, 36, 38 may be tapered to facilitate projection through apertures of a flexible anchor grid.

As mentioned above, flexible anchor grids are available in different sizes that are designed for different applications and these different flexible anchor grids may have differently sized apertures. Thus, the dimensions of the teeth of the engagement section may vary. For example, with flexible anchor grids having nominal apertures of about 1 inch square, each tooth 32, 34, 36, 38, may have a width in the range of about 0.50 to 1.00 inches (1.27 to 2.29 cm), a depth in the range of about 0.50 to 1.10 inches (1.27 to 2.79 cm), and a height in the range of about 0.30 to 1.00 inch (0.76 to 2.54 cm). Preferably, each tooth 32, 34, 36, 38, would have a width (in the x-direction) of about 0.87 inch (2.22 cm), a depth (in the z-direction) of about 1.00 inch (2.54 cm), and a height (in the y-direction) of about 0.50 inch (1.27 cm). It will be understood that these dimensions are not exact, and that variations may occur during manufacturing.

Another feature of the engagement section 30 is that the teeth 32, 34, 36, 38, are spaced apart from each other by slots 40, 42, 44, respectively, that are configured to receive the longitudinal strands of a flexible anchor grid (see, FIGS. 3 and 6). Preferably, the slots 40, 42, 44, are about 0.18 inch (0.47 cm) to 0.62 inch (1.58 cm) in width. More preferably, each slot 40, 42, 44, has a width of about 0.25 inch (0.63 cm). It will be understood that these dimensions are not exact, and the variation may occur during manufacturing. Note that the number of teeth and the flexible anchor grid, as depicted, are not drawn to scale and are not intended to limit the scope of the invention. Rather, the teeth and the flexible anchor grid have been simplified to facilitate a better understanding of the invention. It will be appreciated, for example, that a block having a rear surface of about 12 inches in width may have in the neighborhood of 11 teeth.

Another function of the engagement section 30 is to position a block 10 in a predetermined orientation with respect to one or more blocks in an adjacent course of blocks so that the adjacent courses interlock with each other. As shown in FIGS. 1 and 6, and 7, the generally perpendicularly oriented abutment surface 50 of the engagement section 30 is also configured to operatively engage the rear surface 18 of a block 10 in an adjacent course. This allows courses of blocks to be positioned a predetermined distance from each other, preferably in an upwardly receding slope or "batter" (see, FIGS. 6 and 7).

It will be appreciated that the angle of the upwardly receding slope or "batter" will depend upon the depth of the engagement section teeth 32, 34, 36, 38, and the location of the teeth 32, 34, 36, 38, relative to the block 10. For example, if the teeth 32, 34, 36, 38, of the engagement section 30 were adjacent the rear wall 18 of the block 10, and the teeth 32, 34, 36, 38, had a depth that was roughly equal to the depth of the apertures of a flexible anchor grid, then the offset between adjacent courses of blocks would be at a first distance, and the slope would be a first value. As mentioned above, though, the depth of the teeth is variable. Therefore, if the depth of the teeth 32, 34, 36, 38, were at their minimum, the offset between adjacent courses of blocks would be at a second, shorter distance, and the slope would be greater than the first value.

Referring to FIGS. 5 and 6, construction of a retaining wall using the above-mentioned blocks in combination with flexible anchor grids is a follows. A surface for receiving the blocks is prepared and a first course of blocks C1 is arranged in a desired pattern. Then the area behind the first course of blocks C1 is backfilled so that it is more or less even with the top surfaces of the blocks of course C1. A second course of blocks C2 is then positioned on top of the first course of blocks C1 such that the engagement section is positioned adjacent the rear surfaces 18 of the first course of blocks C1 so as to position the second course of blocks C2 in a set-back relation relative to the first course of blocks C1. The area behind the second course of blocks C2 is then backfilled so that it is more or less even with the top surfaces of the blocks of the second course. Then, a flexible anchor grid 60 is positioned so that it rests on top of and slightly inward from the rear surfaces 18 of the blocks 10 of the course C2 and on top of the backfill material. Preferably, the flexible anchor grid 60 is positioned so that it overlays a substantial portion of the top surface of the course C2, as shown in FIGS. 3, 6, and 7. A third course of blocks C3 is then positioned on top of the second course of blocks C2 such that the teeth 32, 34, 36, 38, of the engagement section 30 operatively connect to the flexible anchor grid 60 by projecting through apertures 62, 64, 66, 68, in the grid 60, and with the teeth 32, 34, 36, 38 also positioned adjacent the rear surfaces 18 of the second course of blocks C2 so as to position the third course of blocks C3 in a set-back relation relative to the second course of blocks C2. The procedure is repeated until the desired height is attained. It will be understood that it is not necessary to provide flexible anchor grids for each course of blocks, and that it may be necessary or desirable to omit an anchor grid or grids from between a course or courses. For example, flexible anchor grids 60 may be used between the first and second courses C1 and C2, and third and fourth course C3 and C4 of a structure S having 5 courses, as shown in FIG. 7.

While a preferred embodiment of the present invention has been described, it should be understood that various changes, adaptations, and modifications may be made therein without departing from the spirit of the invention. Changes may be made in details, particularly in matters of shape, size, material, and arrangement of parts without exceeding the scope of the invention. Accordingly, the scope of the invention is as defined in the language of the appended claims.

What is claimed is:

1. A retaining wall structure comprising:

a plurality of blocks arranged in a plurality of generally horizontal courses stacked on top of each other, each block comprising:

a top surface;

a bottom surface, the bottom surface spaced a predetermined distance from the top surface;

a front surface, the front surface extending between the top surface and the bottom surface;

a rear surface, the rear surface extending between the top surface and the bottom surface, the rear surface spaced a predetermined distance from the front surface;

opposing side surfaces, the opposing side surfaces extending between the top, bottom, front, and rear surfaces;

a flexible, anchoring grid having a plurality of apertures therein positioned between an upper course of blocks and a vertically adjacent lower course of blocks and extending into material being retained by the wall in a single, uninterrupted, generally horizontal plane with the flexible anchor grid lying on the top surfaces of the blocks in the lower course of blocks; with, at least one block of the upper course of blocks further comprising an engagement section comprising a plurality of spaced apart teeth depending downwardly from the block bottom surface, with the teeth having front faces aligned in a common vertical plane disposed forwardly from the block rear surface, with the teeth front faces configured to bear against the rear surface of the lower course of blocks to provide a setback for the upper course of blocks with respect to the lower course of blocks, and with the teeth projecting through the apertures of the flexible grid in operative engagement therewith.

2. The retaining wall structure of claim 1, wherein each tooth of the engagement section has a width in the range of about 0.50 to 4.00 inches (1.27 to 10.16 cm).

3. The retaining wall structure of claim 1, wherein each tooth of the engagement section has a depth in the range of about 0.50 to 2.00 inches (1.27 to 5.08 cm).

4. The retaining wall structure of claim 1, wherein each tooth of the engagement section has a height in the range of about 0.30 to 2.00 inches (0.76 to 5.08 cm).

5. The retaining wall structure of claim 1, wherein the opposing side surfaces of at least one of the blocks are non-parallel, relative to each other.

6. A method of constructing a retaining wall, the method comprising the steps of:

a. providing a plurality of masonry blocks, with each block comprising: a top surface; a bottom surface, the bottom surface spaced a predetermined distance from the top surface; a front surface, the front surface extending between the top surface and the bottom surface; a rear surface, the rear surface extending between the top surface and the bottom surface and being spaced a predetermined distance from the front surface; and, opposing side surfaces, the opposing side surfaces extending between the top, bottom, front, and rear surfaces, and being spaced a predetermined distance from each other, with at least one block of the plurality of blocks further comprising an engagement section, the engagement section comprising a plurality of spaced apart teeth depending downwardly from the block bottom surface, with the teeth having front faces aligned in a common vertical plane disposed forwardly from the block rear surface, with the teeth front faces configured to bear against the rear surface of the lower course of blocks to provide a setback for the upper course of blocks with respect to the lower course of blocks;

b. positioning at least one block to form a first horizontal course;

c. backfilling the area behind the first horizontal course;

d. positioning a flexible, apertured, anchor grid so that it rests upon the backfilled area and upon a portion of the first course; and, e. positioning at least one block on top of the first course to form a second course, with the block in the second course being positioned so that at least one tooth of the engagement section projects through an aperture in the flexible anchor grid and at least one tooth of the engagement section engages the rear surface of the first course.

* * * * *